United States Patent [19]

Furukawa

[11] 4,096,975

[45] Jun. 27, 1978

[54] CONTAINER

[76] Inventor: Mureo Furukawa, 8-2-22, Shakujiidai, Nerima-ku, Tokyo, Japan

[21] Appl. No.: 759,626

[22] Filed: Jan. 17, 1977

[30] Foreign Application Priority Data

Jan. 21, 1976 Japan ..... 51-4697[U]

[51] Int. Cl.[2] ..... B67D 3/00

[52] U.S. Cl. ..... 222/552; 215/313

[58] Field of Search ..... 222/551-553, 222/562; 251/352, 351, 340; 220/90.4; 215/313, 307

[56] References Cited

U.S. PATENT DOCUMENTS

| | | | |
|---|---|---|---|
| 1,954,541 | 4/1934 | Satz | 215/313 |
| 2,072,432 | 3/1937 | Solomon | 222/553 X |
| 2,158,070 | 5/1939 | Hansen | 222/552 |
| 2,551,203 | 5/1951 | Wheaton | 215/313 X |
| 3,229,867 | 1/1966 | Torii et al. | 215/313 X |
| 3,599,681 | 8/1971 | Hall | 251/352 X |

*Primary Examiner*—Joseph F. Peters, Jr.
*Assistant Examiner*—Norman L. Stack, Jr.
*Attorney, Agent, or Firm*—Flynn & Frishauf

[57] ABSTRACT

A container with a circular spout having a spiral groove receiving a closure cap axially movable on the spout to close the spout outlet which is offset from the axis of the spout. The cap is provided with a cutaway section closing the offset spout outlet in the closed position and unblocking the spout outlet in a second rotary position on the spout.

12 Claims, 3 Drawing Figures

CONTAINER

BACKGROUND OF THE INVENTION

This invention relates to a container. More particularly, this invention relates to a container mainly made of flexible materials and having a structure where the cap screwed onto the container is slightly revolved to open and close the outlet provided on the container for easily feeding out the content without taking off the cap.

Containers, for example, for cosmetics, food and medical preparations, presently seen on the market usually are constructed in such a way that the cap must be removed from the container every time one wishes to take out the desired portion of the content, and one often forgets to recap the cap or even misplaces it.

Recently there is known a type of container whose cap is connected to the container by way of a string or the like so as to prevent accidental loss or misplacement of the cap. In any event, all these known containers necessarily accompany removing the cap from the container when taking out the content.

There is known another type of containers for seasonings in powdered form which has a hole notched on its upper periphery of the container and a similar hole on the peripheral side of the slidable cap. By sliding the cap, holes are aligned to form an opening for shaking the content out. It is however impossible to achieve a perfect seal for such a container, and therefore this type of container is generally not suitable for liquid or viscous content. If this type of container is filled with paste, the content which had leaked during the use would stick and harden to the area around the opening and obstruct the sliding motion of the cap. It is at the same time not sanitary.

Disadvantages and defects of such types of containers and capping include:

(a) use of both hands to open and close (b) misplacement and loss of removed cap; or tenuously loose recapping resulting therein (c) non-assurance of tight seal on closure if:

(d) spiral thread screw or other fastening is not carefully tightened;

(e) aperture-alignment type is employed, given that tolerances cannot, with such devices and materials, be so close as to effect a true seal;

with resultant:

(a) contamination, oxidation, etc. of contents, (b) soiling by contents of container aperture and cap, (c) soiling of surfaces and objects in vicinity, (d) soiling of fingers, hands, and clothing of user, (e) interference with closure and seal due to accretion or clotting of contents around container aperture and cap or cap aperture, (f) accidental extrusion or leakage if not re-capped or not properly re-capped.

An object of this invention is to obviate and ameliorate said defects. Another object is to provide an improved container of an extremely high utility value which can be used to hold materials in powdered form, in semi-liquid form, in paste form or in viscous liquid form, and which is extremely easy to handle when taking out the content.

Still another object is to provide a container for cosmetic preparations such as tooth paste, cleansing cream and hair cream, for food such as mayonnaise, seasonings and condiments in powdered form, for medications in ointment form, and for household goods such as cleaning agents, mainly made of flexible materials.

SUMMARY OF THE INVENTION

The container according to this invention comprises a circular head having a spiral groove at the top of the container, and an outlet projecting from the top of the head at a point off-center near the periphery of the head. A cap is provided which has an opening and a closure means to close the outlet and a spiral groove for engaging the spiral groove of the container. In a preferred arrangement, the remainder of said top surface is sloped downward slightly from the horizontal plane of the opening of the cap.

BRIEF DESCRIPTION OF THE DRAWINGS

The drawings show one embodiment of the container in accordance with the present invention wherein.

DETAILED DESCRIPTION

Figure 1:
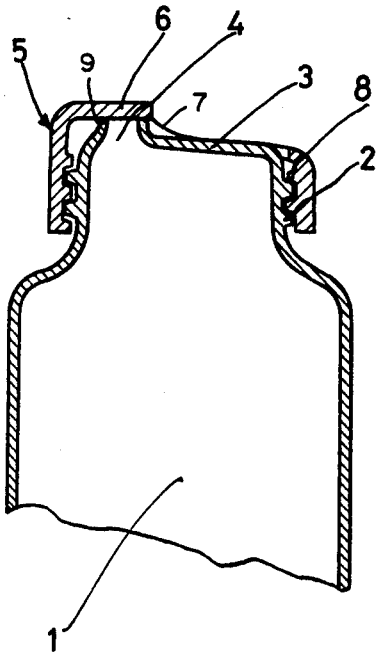
FIG. 1 is a partial cross sectional view of a container of the present invention.
Figure 2:
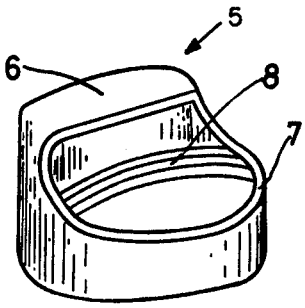
FIG. 2 is an oblique view of the cap of said container.
Figure 3:
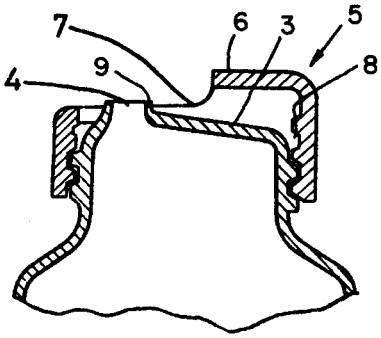
FIG. 3 is a partial cross sectional view of said container with its cap "open".

A circular head 3 having a spiral groove 2 is incorporated integrally to the top of the container. An outlet 4 is provided on the top of the head 3 at a point off-center near the periphery of the head 1. Outlet 4 has a surrounding raised flange 9. A cap 5, provided with an opening 7 having a closure means 6 to close the outlet 4 and with a spiral groove 8, is engaged with the spiral groove 2 of the container 1. The remainder of the top surface of the cap may be optionally sloped downward slightly from the horizontal plane of said opening 7. The container in accordance with the present invention is made of such flexible materials as synthetic resins including polyethylene, polypropyrene or polyvinyl chloride, thin metal sheets such as aluminium or is made of glass.

The container 1 and the cap 5 may be made of the same material, or of different materials. For example, the container may be made of soft polyethylene and the cap of hard polyethylene; or the container of aluminium thin sheet and the cap of polypropyrene.

It is extremely easy and simple to use the container of the present invention. The container 1 is held by the fourth finger and the little finger in the palm of one hand whereas the cap 5 is held by the middle finger, the index finger or the thumb of said hand and is revolved in the counterclockwise direction by 180 degrees. This will slide the closure means 6 of the cap, open the outlet 4 of the container and allow taking out of the content. When the cap 5 is revolved back in the clockwise direction by about 180 degrees, the closure means 6 of the cap will close the top of the outlet 4 and the closure means 6 is tightened over the opening 4 by the force of the screw so that a tight seal can be effected even by children. As see in FIG. 1, the raised flange 9 surrounding the opening when abutting the closure means 6, improves the tight seal.

It is also possible to improve the tightness of the seal by having the closure means 6 of the cap 5 sloped downward slightly from the horizontal plane of said opening so that the closure means 6 would more or less ride over the outlet 4 when the cap is revolved in the clockwise direction, thus utilizing the elasticity of the material of the cap or of the container head and causing the outlet 4 and the closure means 6 to adhere to each other tightly. In some cases, the above effect can be achieved by slightly sloping the plane of the outlet 4 from the horizontal.

When a still higher degree of air tightness is desired, a packing such as one made of a thin membrane of plastic foam may be attached to the lower plane of the closure means 6 which contacts the outlet 4.

With a container made of flexible materials such as tubes for toothpaste, the content often leaks from the outlet, thereby obstructing replacement of the cap. The cap for a container of the present invention is so easy to hold that by lightly pulling the cap and the container apart in opposite directions the leaking content is sucked back in the outlet. Thus, it is possible to keep the closure means and the vicinity of the outlet clean.

The ease of use, even by children, and the tightness of closure afforded by this device are advantageous merits resolving the problems and defects listed above with respect to conventional containers hitherto available, e.g. requiring both hands to open and close, loss of cap, conscious effort to effect tight seal, spillage, blockage of aperture, etc.

What is claimed is:

1. A container and closure device comprising:

a container having a circular head at the top thereof, said head having an external spiral groove therein;

an outlet projecting upwardly from the top of said head at a point off-center near the periphery of said head, the remainder of said head being closed, said outlet having a raised area therearound which extends above the remaining portion of said closed head; and a cap having an opening therein, a closure means which is engagable with said raised area to close said outlet of said head, and an internal spiral groove for engaging said external spiral groove of the said container, said closure means of said cap opening and closing said outlet of said head by turning of said cap relative to said container, said opening of said cap being at least partly in registration with said outlet of said head when said cap is in an open position on said container and said closure means being in engagement with said raised area when said cap is in a closed position on said container.

2. The container and closure device of claim 1 wherein said outlet of said container lies in a given plane.

3. The container and closure device of claim 2 wherein said closure means of said cap is sloped relative to said given plane to improve the seal upon engagement of said closure means and said raised area around said outlet.

4. The container and closure device of claim 3 wherein said cap is made from an elastically resilient material.

5. The container and closure device of claim 3 wherein said given plane is a horizontal plane and said closure means is sloped downwardly from the edge of said cap nearest said closure means.

6. The container and closure device of claim 5 wherein said closure means extends from an edge of said cap.

7. The container and closure device of claim 1 wherein at least one of said container and cap is made of a synthetic resin material.

8. The container and closure device of claim 7 wherein said synthetic resin is a resin selected from the group consisting of soft polyethylene, hard polyethylene polypropylene and polyvinyl chloride.

9. The container and closure device of claim 1 wherein at least one of said container and cap is made of a thin metal.

10. The container and closure device of claim 9 wherein said thin metal is aluminum.

11. The container and closure device of claim 1 wherein said container is made of glass.

12. The container and closure device of claim 1 wherein said container and cap are made of different materials.

* * * * *